US009151047B2

(12) United States Patent
Gryba

(10) Patent No.: US 9,151,047 B2
(45) Date of Patent: Oct. 6, 2015

(54) UNDERCUT EXCAVATION METHOD WITH CONTINUOUS CONCRETE FLOORS

(71) Applicant: 2341451 ONTARIO INC., Toronto (CA)

(72) Inventor: Charles Michael Gryba, Toronto (CA)

(73) Assignee: 2341451 Ontario Inc., Toronto, Ontario (CA)

( * ) Notice: Subject to any disclaimer, the term of this patent is extended or adjusted under 35 U.S.C. 154(b) by 0 days.

(21) Appl. No.: 14/354,391

(22) PCT Filed: Oct. 11, 2012

(86) PCT No.: PCT/CA2012/000939

§ 371 (c)(1),
(2) Date: Apr. 25, 2014

(87) PCT Pub. No.: WO2013/059911

PCT Pub. Date: May 2, 2013

(65) Prior Publication Data

US 2014/0237936 A1 Aug. 28, 2014

(30) Foreign Application Priority Data

Oct. 26, 2011 (CA) ..... 2756266

(51) Int. Cl.

| | |
|---|---|
| ***E04B 1/00*** | (2006.01) |
| ***E04B 5/32*** | (2006.01) |
| ***E02D 29/055*** | (2006.01) |
| ***E21C 41/16*** | (2006.01) |

(52) U.S. Cl.
CPC ..... *E04B 5/32* (2013.01); *E02D 29/055* (2013.01); *E21C 41/16* (2013.01)

(58) Field of Classification Search
CPC ..... E04B 5/32; E02D 29/055
USPC ..... 52/741.11, 741.15, 169.9, 236.6; 405/134
See application file for complete search history.

(56) References Cited

U.S. PATENT DOCUMENTS

| | | | | | |
|---|---|---|---|---|---|
| 3,184,893 | A | * | 5/1965 | Booth | 52/741.15 |
| 4,015,432 | A | * | 4/1977 | Ball | 405/229 |
| 4,221,090 | A | * | 9/1980 | Pahl | 52/169.9 |
| 5,522,676 | A | * | 6/1996 | Gryba | 405/134 |
| 5,944,453 | A | | 8/1999 | Gryba | |

FOREIGN PATENT DOCUMENTS

| | | |
|---|---|---|
| WO | 2004055273 | 7/2004 |

* cited by examiner

*Primary Examiner* — Basil Katcheves
(74) *Attorney, Agent, or Firm* — Jansson Munger McKinley & Shape Ltd.

(57) ABSTRACT

The present invention provides a technique in undercut excavation that allows a continuous steel reinforced concrete floor to be set up or installed over a large width and length and installing continuous steel reinforced concrete floors in any subsequent lifts. Using the present invention, the continuous concrete floor can be extended at a later date if the stopping area is extended at some future date.

9 Claims, 6 Drawing Sheets

UNDERCUT EXCAVATION METHOD WITH CONTINUOUS CONCRETE FLOORS

BACKGROUND OF THE INVENTION

1. Field of the Invention

This invention relates to a method for excavation from the top down, usually known as "undercut" excavation using concrete floors that become a roof for the next lower level of excavation. More particularly the invention relates to how to develop a continuous concrete floor using only standard size 5 m×6 m drifts openings in the top lift or with some modification, continuous floors in the second and subsequent lower levels.

2. Discussion of the Prior Art

There are many descriptions of conventional undercut-and-fill mining methods in the mining literature, however, probably one of the best is to be found in the article entitled: "Undercut-and-Fill Mining at the Frood-Stobie Mine of the International Nickel Company of Canada, Limited" by J. A. Pigott and R. J. Hall published in The Canadian Mining and Metallurgical Bulletin for June, 1961, Montreal, pp. 420-424.

It is also already known to mine ore by an undercut-and-fill method while providing concrete floors that serve as a roof for the subsequent cut on a lower level. For example, in an article entitled "Kosaka Mine and Smelter" published in the Mining Magazine—November 1984, page 404, a method called underhand cut and fill using an "artificial roof" is disclosed. According to this method, the cross-cuts are back-filled by first installing a layer of reinforcing steel mesh near the floor, followed by pumping in a 500-600 mm thickness of a comparatively weak concrete mix and, when it is dry, backfilling with a mixture of sand, volcano ash and 3.5% cement. When alternate cross-cuts have been completed across the length of the mining block, the intermediate 4 meter wide ribs of ore are also extracted, so that the entire slice of ore is replaced by a layer of reinforced concrete topped by loosely cemented fill. Then, when mining of the next lower cut is undertaken, the concrete which has been placed on the floor of the level above, now forms an artificial roof.

U.S. Pat. No. 5,522,676 discloses an undercut excavation method in which wider drifts can be excavated under the concrete floor above. In this method posts are inserted into the floor of the drift, by drilling post holes in the ground and inserting concrete posts in such holes. A concrete floor is poured on the ground and on the top ends of the posts. This permits safe excavation at wider drifts beneath the concrete floor which now serves as a concrete roof for the excavation because the floor above is not only supported on the side walls of the drift below but the posts help support the span of the concrete floor over the area being excavated below.

The method in U.S. Pat. No. 5,522,676 provides for a multi-level undercut excavation, using an undercut-and-fill mining method, whereby the same procedure is repeated at each level as the excavation progresses downwardly from level to level until a desired number of levels has thus been excavated. In the undercut-and-fill mining method, the excavated rooms are back-filled with a suitable fill after excavating the same. Moreover, holes may be drilled around the posts inserted into the ground, and blasted with explosives to break the ground around the posts without, however, damaging the posts themselves. This facilitates excavation under the concrete floor/roof thereafter and minimizes damage to the posts during excavation.

It has also been disclosed in U.S. Pat. No. 5,522,676 that as an improvement on the method disclosed in U.S. Pat. No. 5,522,676 additional posts may be stood-up in plumb on top of the posts previously inserted into the holes to provide further support to the concrete roof and thus an enhanced safety. This is called "double post" excavation, or when applied to mining "double post mining" or "DPM".

When a set of concrete posts is installed in holes in an undercut excavation as mentioned above or as part of the double post excavation or DPM, the posts have zero load. Once the concrete floor/roof has been cast and the excavation under the floor has been performed, there will be a load applied to the posts. The load is primarily from the cemented rock fill backfill, concrete roof and possibly any overlying rock above. If the excavation is only a one level excavation, it is likely that there may be a structure placed over it, such as a building or the like, which will exert an additional load onto the posts over and above the load exerted by the floor/roof poured there over. The same applies to a multi-level excavation. Also in a mining undercut-and-fill method, loads are transmitted to the posts via the backfill as the rock or ore formations move or relax. The biggest load is from the backfill. Once the backfill has settled and moved slightly the backfill load is transferred to the walls of the drift below. The concrete posts are, of course, rigid and they could overload and fail particularly during seismic events, such as a rock burst or earth quake, which may produce massive energy releases.

U.S. Pat. No. 5,944,453 provided improvements to the method disclosed in U.S. Pat. No. 5,522,676 by providing protection against rapid loading from seismic events or against excessive ground movement. The improvement comprised:

(a) drilling holes of predetermined size and length in the ground;

(b) placing at the bottom of each hole resilient elements capable of absorbing shock energy or excessive loads due to ground movements;

(c) inserting concrete posts into the holes, these posts having their bottom ends resting on the resilient elements and having their top ends essentially flush with the ground, the posts being capable of supporting a concrete roof on their top ends;

(d) pouring a concrete floor on the ground and on the top ends of the posts, and (e) excavating beneath the concrete floor which now serves as the concrete roof for the excavation, with the resilient elements providing protection against seismic events in the area of the excavation or against ground movement exceeding failure load of the concrete posts.

In the prior art each drift on backfilling is a monolithic 5 m w×6 m h×100 m drift. Mining companies using this method usually mine the next lower set of drifts at right angles so that the open spans are limited to 5 m and the cold joint lengths are minimized to 5 m as well. Cold joints are formed when concrete is backfilled against concrete that has previously hardened or set.

The present application is directed to a further improvement in the undercut excavation methods disclosed in the prior art and in particular in U.S. Pat. No. 5,522,676 and No. 5,944,453 by providing a method of pouring continuous concrete floors and instrumentation to be used in the excavation. U.S. Pat. No. 5,944,453 and No. 5,522,676 are hereby incorporated by reference in their entirety.

SUMMARY OF THE INVENTION

The present invention provides a technique in undercut excavation that allows a continuous steel reinforced concrete floor to be set up or installed over a large width and length and installing continuous steel reinforced concrete floors in any subsequent lifts. Using the present invention, the continuous concrete floor can be extended at a later date if the stopping area is extended at some future date. For example if an ore body is 100 m to 500 m in length, the floor can initially be set up in 100 m×100 m area and attached or extended to cover the entire 100 m×500 m plan area. Mining of each area can be at different elevations or parts of the concrete floor can be extended years later.

It is, therefore, an object of the present invention to provide a method of undercut excavation or mining including constructing continuous concrete floors. A continuous concrete floor preferably is set up from a series of 5 m w×6 m h sized openings in the rock on the first lift of excavation or wider openings on subsequent lower lifts.

A further object of this invention is to create a continuous concrete floor in a simple and efficient manner starting from a series of 5 m×6 m drifts to mine ore bodies with a plan area of 10 m×100 m or larger opening in both directions.

A further object of the invention is to use the continuous concrete floor in the undercut excavation method of the present invention to contain the cemented backfill while allowing the concrete posts and spring pads to compress to match the loading of the backfill/or rock from above or below. In highly stressed rock the rock can expand upward to cause the posts below to fail.

In the development of the present invention, computer modelling of the posting, backfill and elastic pads have shown that the posts have to compress to match the arching of the backfill which creates the strength for the backfill to be self supporting.

A still further object of this invention is use similar techniques to build continuous concrete floors on subsequent lower lifts of excavation.

Other objects and advantages of this invention will be apparent from the following description thereof.

BRIEF DESCRIPTION OF THE DRAWINGS

The invention will now be described, by way of example, with reference to the accompanying drawings in which the same parts are designated by the same numerals, and in which.

DESCRIPTION OF THE PREFERRED EMBODIMENTS

Figure 1:
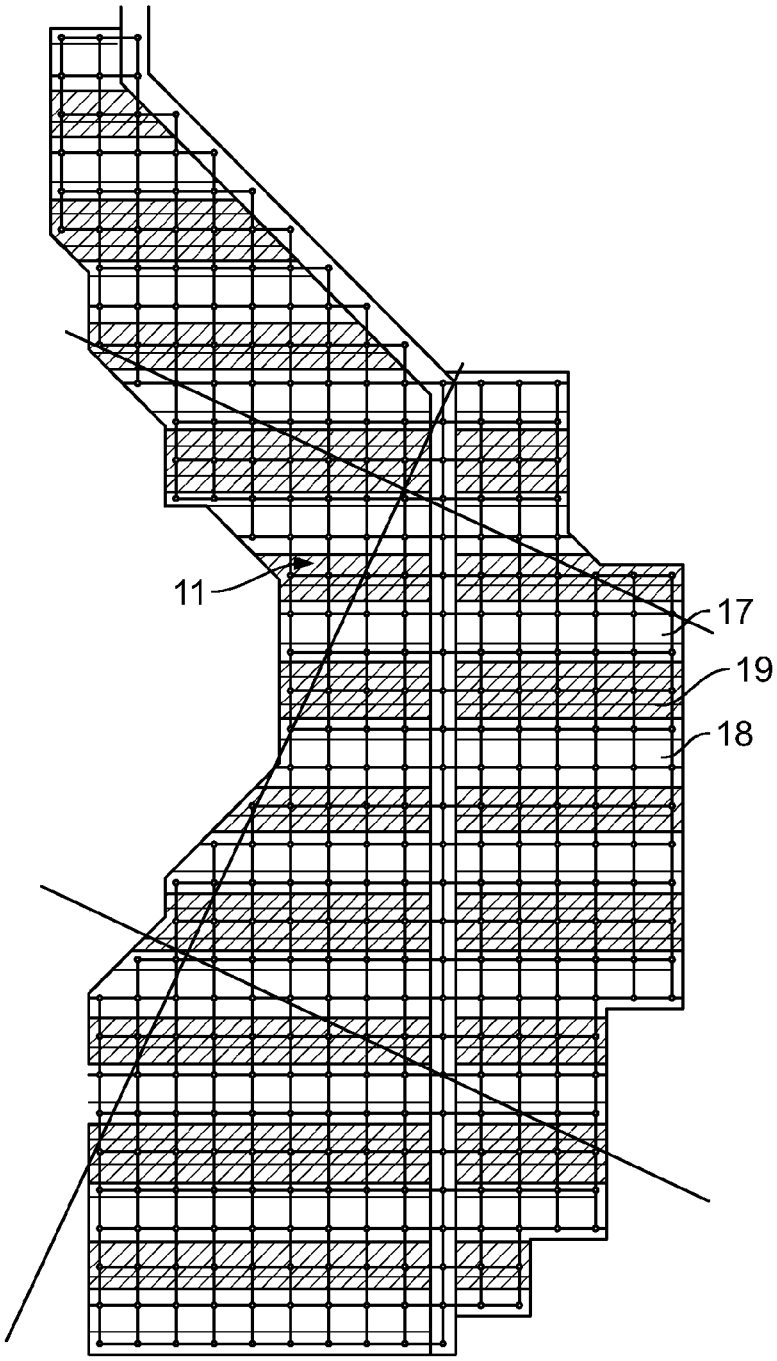
FIG. 1 is a top plan view of a computer model of an excavation having a series of parallel drifts to be excavated according to the method of the present invention.

Many mining companies have mined ore and filled stopes with a weak concrete floor on top of fill to provide a roadbed or prevent losses of ore into the fill below and then fill each drift that is mined with weak concrete—cemented rock fill with 5-15% cement. On backfilling each drift is a monolithic 5 m w×6 m h×100 m drift. Cold joints are formed when concrete that is backfilled against concrete that has previously hardened or set.

The present invention provides a technique in undercut mining that allows a continuous steel reinforced concrete floor to be set up or installed over a large width and length. A continuous concrete floor installed in accordance with the present invention can be extended at a later date if the stoping area is extended at some future date. For example in an ore body that is 100 m to 500 m in length the floor can be set up in 100 m×100 m areas and attached or extended to cover the entire 100 m×500 m plan area. Mining of each area can be at different elevations or parts of the concrete floor can be extended years later.

In accordance with the present invention, the excavation method starts by setting up an initial concrete floor (for example a 100 m×100 m) using standard 5 m width×6 m height×4 m drift rounds or using a mechanical rock cutting machine such as a road header to excavate a 5 m×6 m×100 m long drift. When the present invention is used in association with double post mining, support posts are installed into the ore or rock below prior to installing the concrete floor. The procedure to drill post holes, install posts, pre-break the area around the posts is described in U.S. Pat. No. 5,944,453 and No. 5,522,676. The size of the drift rounds may vary. For example drift rounds could be 4 m×6 m×50 m long whatever size standard single drifts can be made, safe from or falls of ground.

The present invention is directed to how to create a continuous concrete floor in stages so that on completion a continuous concrete floor covers a 100 m×100 m area. In addition this concrete floor is designed to be extended at a later date, in all lateral directions.

This invention is characterized by the following advantages:

(1) A concrete floor in one 5 m×6 m w×100 m long drift can be attached to an adjoining 5 m×6 m×100 m long drift that is mined 30-100 days later.

(2) The ends of the 5 m×6 m×100 m long drift can be attached to an adjoining concrete floor months or years later if the continuous concrete floors have to be extended.

(3) Computer modeling of the loading on the concrete floor shows that the floor can move 2-400 mm or more when support pillars are removed by mining and the drift is supported on cemented rock fill of previously filled drifts.

(4) Ore body dips can be flat beds to vertical dipping and every degree between. The present invention can be utilized for supporting concrete floors at all dips.

When using double post mining, the present invention provides a method for setting up concrete floors in wide spaces say 15 m wide×100 m long areas that have a grid of concrete posts installed at a pre-designed spacing of for example 7.5 m×7.5 m spacing. The present invention preferably uses 400 T bearing capacity concrete posts to provide temporary support of a concrete roof while a large area is mined underneath. For example openings below cemented rock fill (under cut and fill mining) normally have a maximum safe mining support width of 5-6 m without falls of cemented rock fill at or near the cold joints whereas according to the present invention, DPM posting allows widths of 15 meters or more widexan unlimited length because the post provides temporary support and the continuous concrete floors don't allow pieces of cemented rock fill to fall off, the continuous concrete floor is a continuous safety net.

Setting up concrete floors underground requires that the safe movement of the floors and posts must be matched to the arching of the cemented rock backfill above the floors. The cemented rock backfill has to move a certain amount before it becomes self supporting. If the concrete posts and floors are rigid, the posts and floors will fail due to the high loads. U.S. Pat. No. 5,944,453 has disclosed posts that can be compressed. This allows the backfill above to move or arch enough to be self supporting. The backfill has to have enough strength to be self supportive, if it is to weak it will cause the floors and posts to fail. Geotechnical computer modelling normally is used in accordance with the present invention to match the arching strength of the cemented rock fill to the compressive movement designed into the compressive posting system. For example if the fill moves 100 mm prior to being self supporting, the posts have to be able to compress 100 mm while staying within their design loading parameter of 500 Tons. Rock mechanics data shows that earth loads are transmitted around the backfilled stope thus the backfill is mainly supporting its own weight by transfer of load to the adjoining walls below. Weaker backfill compresses, thus small displacement earth loads only compress the fill. If the backfill is too strong then it doesn't compress and transfer the load to walls but the entire earth load from above will primarily be on the rigid posts.

Figure 2:
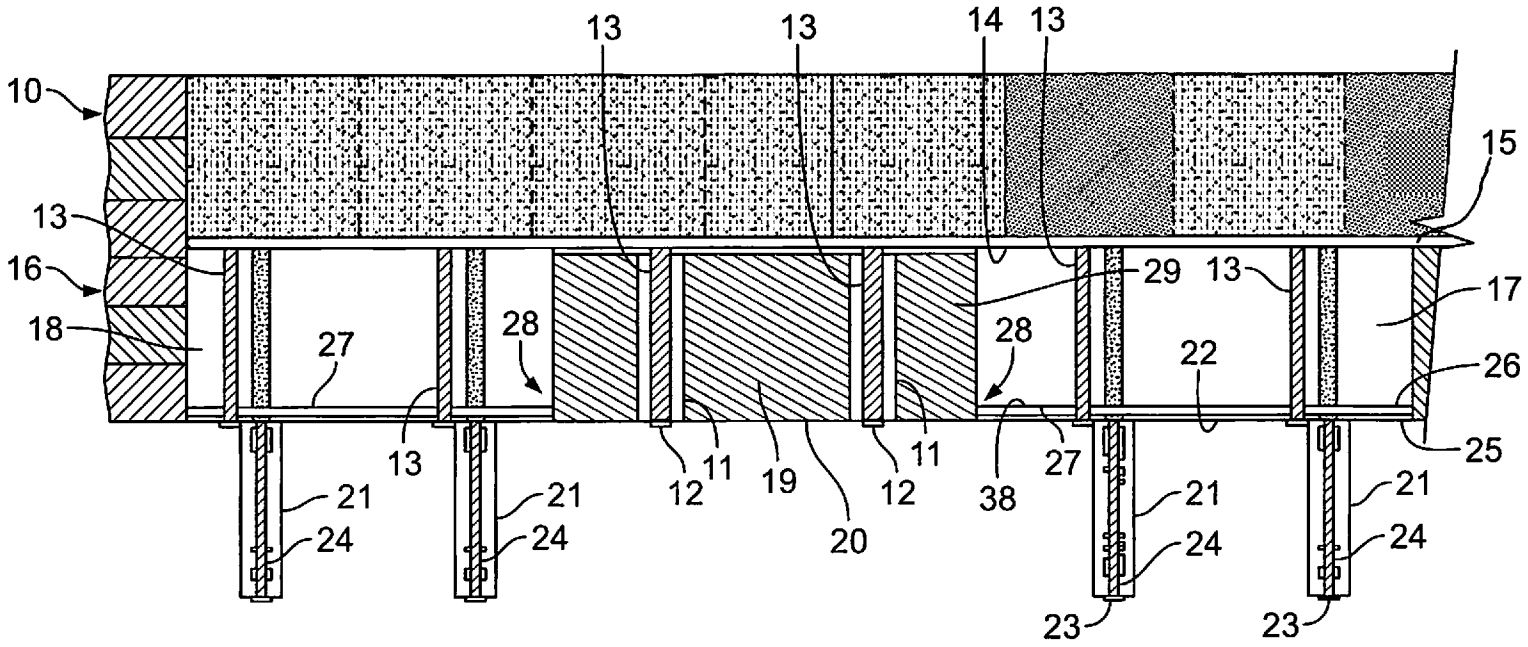
FIG. 2 is a partial section view of the excavation of FIG. 1.

Referring to FIGS. 1 and 2, in one embodiment the method of excavation of the present invention and utilizing double post mining comprises a method of undercut excavation by creating a top slice 10 at ground level by drifting a series of openings in the ground of predetermined size and length for example 5m×6 m×100 m long drifts as shown in the embodiment illustrated in FIG. 2. Post holes 11 of predetermined grid, size and length are drilled in the ground and resilient elements 12 capable of absorbing shock energy or excessive loads due to ground movement have been placed in the bottom of the holes. FIG. 1 shows the computer model grid for post holes 11. Then concrete posts 13 are inserted into the holes 11, with the posts 13 having their bottom ends resting on the resilient elements 12 and having their top ends essentially flush with the floor 14 of the top slice 10. The posts 13 should being capable of supporting a concrete roof on their top ends. A steel reinforced first concrete floor 15 is poured on the floor 14 of the top slice 10 and on the top ends of said posts 13, and excavating beneath said concrete floor 15 which now serves as the concrete roof for the excavation can commence.

In the embodiment illustrated the method according to the present invention of excavating a first lift 16 underneath the first concrete floor 15 comprises the following steps:

(a) A first drift 17 corresponding to the height of the posts 13 inserted in the holes 11 in the rock below the top slice 10 and in the embodiment shown in FIG. 2 with two of said posts exposed across the width of the first drift 17 is excavated. The width of the drift can vary so long as the concrete floor above is safely supported by posts 13 or unexcavated pillars or rock or cement rock fill that has been backfilled into adjacent drifts as explained below.

(b) A second drift 18 corresponding to the height of the posts 13 inserted in the holes 11 in the rock below the top slice 10 and in the embodiment shown in FIG. 2 with two of said posts exposed across the width of the second drift 18 is excavated. The width of the drift can vary so long as the concrete floor above is safely supported by posts 13 or unexcavated pillars or rock or cement rock fill that has been backfilled into adjacent drifts as explained below. The second drift 18 is separated from the first drift 17 by a third drift 19 of unexcavated ore 20;

(c) Once the first drift 17 has been excavated along its length, if using double post mining, post holes 21 of predetermined grid, size and length are drilled in the floor 22 of the first drift 17. At the bottom of the post holes 21 resilient elements 23 capable of absorbing shock energy or excessive loads due to ground movement are placed. Then concrete posts 24 are inserted into the holes 21, with the posts 21 having their bottom ends resting on the resilient elements 23 and having their top ends extending above the floor 22 of the first drift 17. Resilient elements 23 may be attached to the bottom of posts 24 before the posts 24 are inserted in the post holes 21. The floor 22 of the first drift 17 is backfilled with broken rock or ore 25 and graded to a point below the top of the posts extending above the floor 22 of the first drift 17. The broken rock or ore for example may be backfilled to within 50 mm of the top of the posts.

(d) A thin plastic layer 26 is installed over the broken rock or ore 25. While in the preferred embodiment the thin layer is a plastic membrane that prevents liquid cement from draining down into the levelled broken rock or ore 25, any other material can be used that will prevent liquid cement from draining down into the levelled broken rock.

(e) Then a pattern of reinforcing steel 27 in the form of a mesh, rebar or screen, is installed to provide adequate strength to the concrete floor to be poured over the plastic layer 26 and broken ore 25 on the floor 22 of the first drift 17. The reinforcing steel 27 is lifted and supported the desired height above the thin plastic layer 27 per standard civil engineering techniques.

Figure 3:
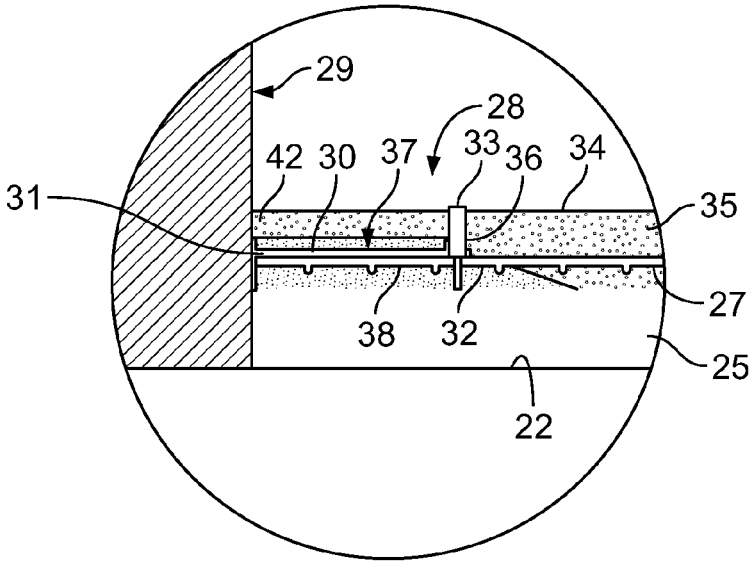
FIG. 3 is a detailed view of a form and sand fill utilized around the base of the walls of a drift in accordance with one embodiment of the invention.
Figure 4:
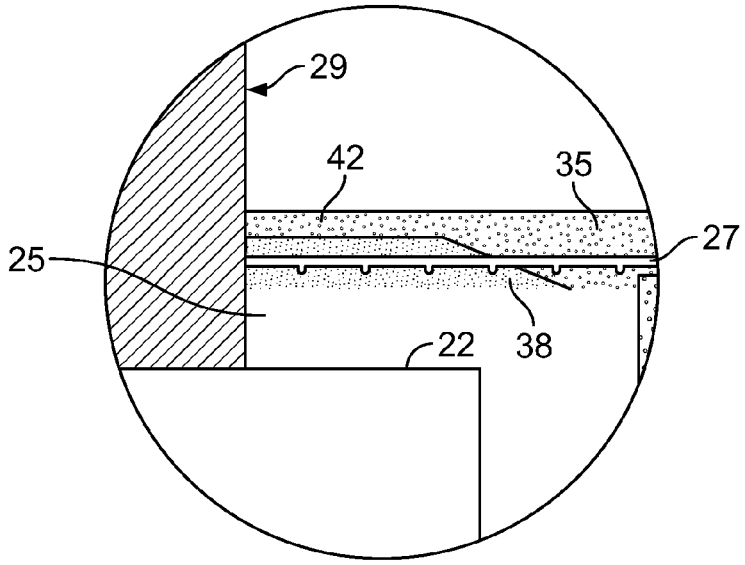
FIG. 4 is a detailed view of a concrete floor poured over the sand fill of FIG. 3 and with the form removed in accordance with one embodiment of the invention.
Figure 5:
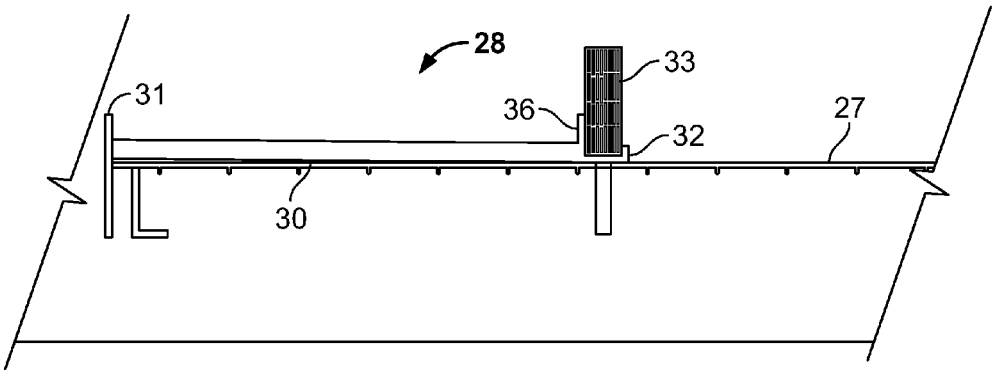
FIG. 5 is a detailed view of the form of FIG. 3 and steel reinforcing layer before adding the sand fill.
Figure 6:
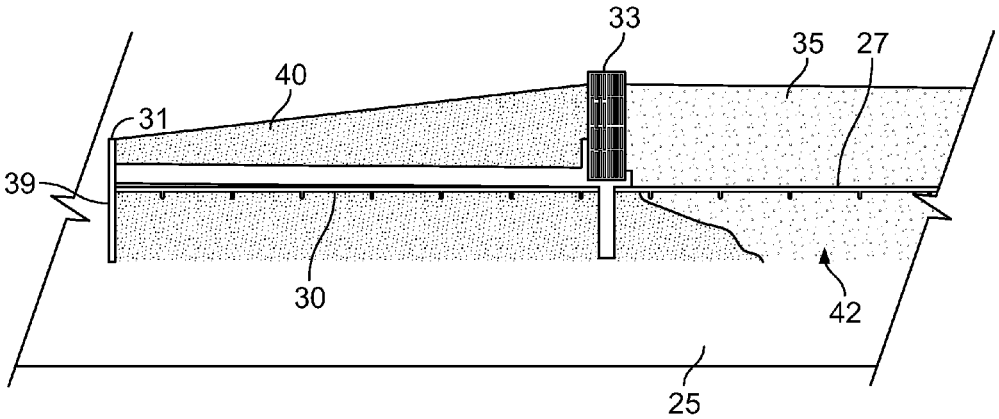
FIG. 6 is a detailed view of the form of FIG. 3 and sand fill as used around the periphery of the concrete floor not in proximity to the walls of the drift.
Figure 7:
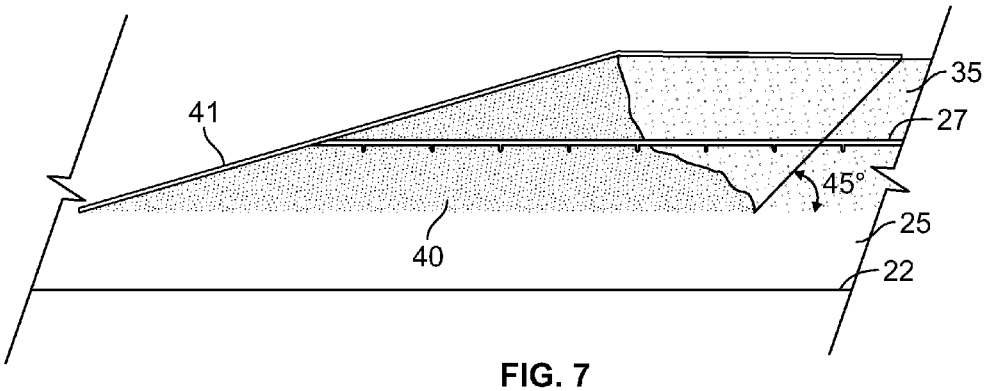
FIG. 7 is a detailed view of the periphery of the concrete floor of FIG. 6 showing the sand fill and a ramp after the form of FIG. 3 is removed.

(f) Forms, generally indicated at 28, are then installed around the perimeter of the floor 22 of the first drift 17. In the embodiment illustrated the forms 28 are installed about eighteen inches or so from the perimeter walls 29 of the first drift 17. The distance of the forms from the perimeter walls may vary so long as the distance is at least as long as the length of any overlapping reinforcing steel from adjoining floors (as described below) generally fifteen to twenty times the diameter of the rebar in the reinforcing steel 27. Around the perimeter of the first drift 17 and next to the wall of the drift one embodiment of a suitable form 28 is illustrated in FIGS. 3 and 5. The form 28 consists of a series of steel rods 30 having one end 31 adapted to abut against the wall 29 on the first drift 17 and the another end 32 adapted to support planking 33 standing on edge the height of the top surface 34 of the concrete floor 35 to be poured above the reinforcing steel 27. In the embodiment illustrated the end 32 is in the shape of an upstanding U-shaped bracket 36. The space 37 between the edge of the wall 29 of the drift 17 and the planking 33 is filled with sand 38 so the reinforcing steel 27 is covered. The form 28 when used against the wall of the drift is removed as the concrete floor 35 is poured so the concrete completely covers the sand as described below and shown in FIG. 4. At the edge of the concrete floor to be poured not against the walls of the drift, a form 28 one embodiment as shown in FIG. 6 is used. In this embodiment the form 28 has an endplate 39 at the end 31 remote from planking 33. Sand 40 fills the space between endplate 39 and planking 33. The concrete floor 35 is poured only to the planking 33. Once the concrete floor 35 has set the form 28 and planking 33 can be removed. To protect the sand 40 and exposed reinforcing steel 27 from damage a ramp 41 as shown in FIG. 7 can be utilized. The design of the forms 28 can vary from the embodiment shown so long as they retain the sand placed over the reinforcing steel around the periphery of the concrete floor to be poured to result in the arrangement shown in FIG. 4 next to the walls of the drift and as shown in FIG. 7 with or without the ramp.

(g) Concrete 35 is then pumped or poured over the reinforcing steel 27 and sand 38 to form a concrete floor 35 in the first drift 17 with a thickness sufficient to support cemented rock fill or the equivalent above the concrete floor 35 when the first drift 17 is tightly backfilled. The concrete floor 35 may have for example a thickness of 250 mm.

(h) As noted above the planking 33 is removed from around the periphery walls of the first drift 17 before the concrete sets and the space filled with concrete without disturbing the sand underneath the concrete between the planking 33 and the edge of the wall of the first drift 17.

(i) Steps (c) to (h) above are repeated with the second drift 18 after it is fully excavated along its length.

(j) The first drift 17 and the second drift are tightly filled with cemented rock fill or the equivalent.

(k) Excavate, drill and blast or road header the third drift 19 corresponding to the unexcavated rock or ore 20 between the first and second drifts can be removed up to the edge of the concrete floors 35 in the first drift and the second drift.

(l) When using double post mining, repeat step (c) for the third drift 19, namely once the third drift has been excavated along its length, drilling post holes of predetermined grid, size and length in the floor of the third drift. At the bottom of the holes resilient elements capable of absorbing shock energy or excessive loads due to ground movement are placed. Then concrete posts are inserted into the holes, with the posts having their bottom ends resting on the resilient elements and having their top ends extending above the floor of the third drift. The floor of the third drift is backfilled with broken rock or ore and graded to a point below the top of the posts extending above the floor of the third drift. The broken rock or ore for example may be backfilled to within 50 mm of the top of the posts.

(m) Remove the sand 38 covering the ends of the reinforcing steel 27 from under the concrete floor 35 of the first 17 and second drifts 18 along the portion of the periphery of the first 17 and second 18 drifts adjoining the periphery of the third drift 19. Sand removal can be done using a high pressure sprayer as one example.

(n) A thin plastic layer is installed over the broken rock or ore on the floor of the third drift. In the preferred embodiment the thin layer is a plastic membrane that prevents liquid cement from draining down into the leveled broken rock or ore.

(o) Then a pattern of reinforcing steel in the form of a mesh, rebar or screen, is installed over the plastic layer to provide adequate strength to the concrete floor to be poured over the plastic layer and broken ore on the floor of the third drift. The reinforcing steel is lifted and supported the desired height above the thin concrete impervious layer. The reinforcing steel in the third drift extends past the periphery of the third drift to overlap the ends of the adjacent reinforcing steel 27 in the first and second drifts.

(p) Concrete is then pumped or poured over the reinforcing steel to form a concrete floor in the third drift with a thickness sufficient to support cemented rock fill or the equivalent above the concrete floor when the third drift is tightly backfilled. The previous sand filled areas along the periphery of the first and second drifts, including a space under the lip 42 of the concrete floor 35 in the first and second drifts, are filled with concrete and the reinforcing steel overlap to form a continuous concrete floor in the first, second and third drifts.

(q) The third drift is tightly backfilled with cemented rock fill or the equivalent.

(r) Steps (c) to (p) are repeated across the first lift to the limit of the ore or to the design limits of that phase of excavation of ore resulting in a continuous concrete floor across the entire lift.

Figure 9:
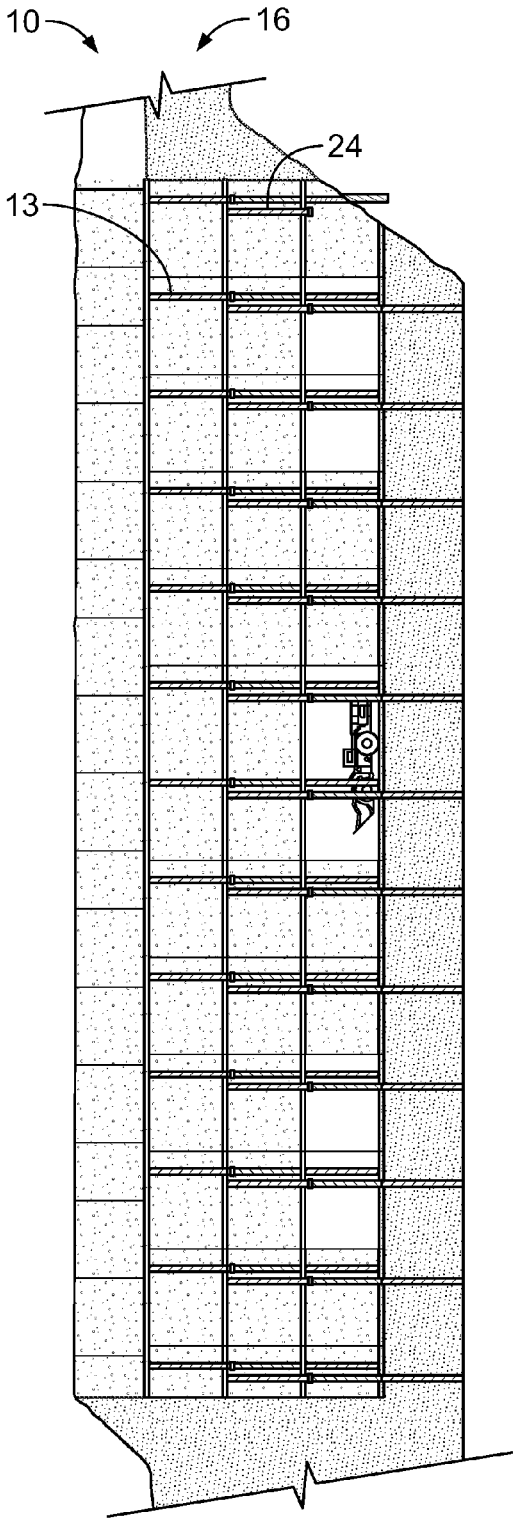
FIG. 9 is a partial section view of an excavation according to the present invention wherein undercut mining is being performed under continuous concrete floors on the lifts above the lift being excavated.

(s) Steps (c) to (r) are repeated for excavation of a second lift beneath the continuous concrete floor of the first lift or any extension of the first lift to a new area as shown in FIG. 9.

Figure 8:
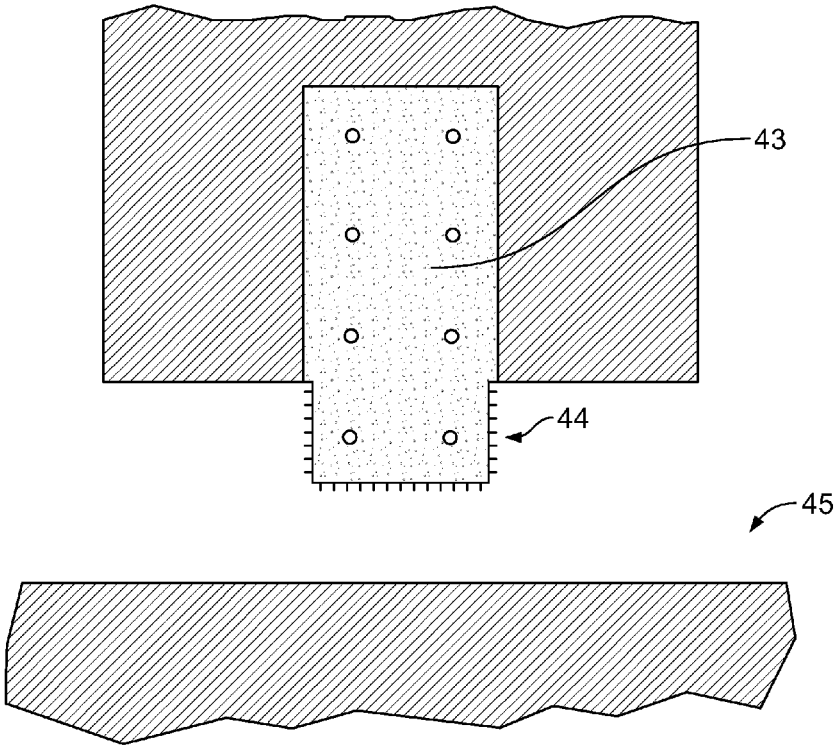
FIG. 8 is a top plan view showing a part of the periphery of a concrete floor not in proximity to the walls of a drift with reinforcing steel exposed.

FIG. 8 shows schematically a concrete floor 43 poured in an excavated area of a drift with the reinforcing steel 44 around the periphery of the concrete floor 43 not in proximity to the walls of the drift exposed prior to pouring a concrete floor in the area 45 to form a continuous concrete floor with concrete floor 43.

At the edge of the area to be excavated, wall pins and rebar hangers are utilized to support the perimeter of the concrete floor slab using convential civil engineering techniques and standards.

When reference is made herein to concrete posts, these include reinforced concrete posts and when reference is made to pouring a concrete floor on the ground and on the top ends of the posts, it also includes the pouring or casting of a reinforced concrete floor, i.e. a floor designed with rebar and screen elements within the concrete, so that the posts cannot puncture the same.

Advantages of the Present Invention

DPM mining according to the present invention provides a new mining method that has the potential to totally revolutionize underground mine planning of midsized ore bodies. The key breakthrough comes from the small stope size—7.5 m×7.5 m×6 m—that has a reinforced concrete roof held up by four large concrete posts. The individual blocks in the initial geological block model now become the stopping plan and the continuous concrete floor is held up with a grid of posts allowing mining in any direction under the concrete floor.

While the original concept of DPM was developed some time ago until recently computer modeling wasn't powerful enough to calculate the redistribution of loads every time a drift round was removed in an individual DPM room. Current 3D modeling answered many of the what if questions: what is the loading on the posts? Does the loading increase with each lower lift? How strong does the backfill have to be? How thick do the concrete floors have to be?

The benefits to the mine owner of using the present invention particularly in association with the double post mining method include:

1. DPM mine planning—The mine plan for DPM mining is the geological block model; all that is required is access to the top 6 m high mining lift and a second access for ventilation and egress. Mining and backfilling of 100% of the 6 m lift proceeds in parallel. A safe planning rule of thumb is that an orebody can support a 1000 tpd mining rate per 100 ore blocks—with the number of blocks known the mining rate can be estimated and then the mine infrastructure designed. Parallel mining and backfilling plus 100% of the ore lift in production gives a much higher mining rate per million tons of orebody compared to other mining methods such as blasthole or cut and fill or underhand drift and fill mining methods.
2. Following the Ore—the normal mine planning process of designing and scheduling stopes and pillars is an iteration process; planning various scenarios takes time and a change in orebody size or shape or a change in metal prices requires a complete redesign. The versatility of the present invention means that mining can halt at any point under the concrete floor if the orebody ends or the grade diminishes. Similarly mining can continue past the concrete to follow the ore, in effect becoming a new top slice. This means that a change in the shape of the ore body or grade will not affect production or require a redesign. Also, in the future if metal prices or ore values increase, a road header can drive through the backfill to reach now profitable ore at the far end of the ore body.

3. Elimination of Work—The present invention eliminates most ground control functions such as rock bolting, cable bolting and shotcreting (except for the top slicing). Other mining functions like cut lose raises, long hole drilling and the equipment to carry out the functions are reduced. The present invention also eliminates a lot of higher cost mining functions—primary, secondary and sill pillar recoveries, fill fences or bulkheads etc. Most mines spend 30% of their labor and material on ground control. Ground control work also reduces development advance rates by 30 to 50%—more development footage or headings, more delays. By eliminating development work, both productivity and safety statistics improve by that percentage.
4. Ore Recovery—The initial geological block model with conventional mining methods is usually chopped by 20% or so by the mining engineers as the size of stopes and pillars don't necessarily follow the orebody. Room and pillar or post pillar mining methods leave 20 to 30% of the orebody behind as non-recovered support pillars. The present invention recovers 100% of the ore identified by the geological block modelling. The present invention can also remove internal dilution (low grade ore blocks that have insufficient value to be milled) as well, thus the mining grade can be higher than the original block model average geological grade. Room grades are confirmed by mapping, face sampling and post hole chip sampling. The orebody can be mined selectively with minimum of internal and wall dilution.
5. Capital Development Cost—The present invention mines the orebody from the top down; pre production waste development is limited to providing access to the top 6 m lift or multiple locations depending on the size or shape of the orebody. Two other factors come into play—less development leads to quicker ore production plus a higher mining rate is achieved earlier. Operating revenue reduces the capital cost dollar for dollar thus the ROI of the project is substantially increased.
6. Mechanized Mining—The present invention provides room to maneuver large road headers and the concrete roof eliminates falls of ground. Ground that is soft enough to cut with a road header usually limits the safe size of openings. The present invention concrete roofs and posts eliminate most ground imperfections. If there is a combination of weak and hard ore the hard sections can be drilled and blasted.
7. Cemented Tailings Fill—Future development of The present invention will examine other opportunities for improvement, such as using paste fill to replace CRF. Using paste fill the posts may have to compress 250 mm and post spacing may have to be reduced to 6 m×6 m. Once the 3D model is calibrated by mining with stiff fill, weaker fills can be modeled. For rooms with one post in the centre, they can be test mined to allow different fills to be evaluated and post loading, thickness of concrete floor etc can all be monitored by instrumentation.
8. Safety—Reducing accidents is a complex operation; the largest source of accidents is development work, scaling, rock bolting and other ground control functions. Falls of ground, falls of backfill or unexpected pillar or back failures, working on broken ore, runs of fill, driving raises etc are all source of injuries. In base metal mines large stope blasts often cause dust explosions. The present invention creates a shop like work environment that can be monitored, uses large equipment with high productivity and reduces the number of miners underground. New hazards such as tripping on rebar or chemical burns from working with concrete will have to be identified and managed.

Test Mine

DPM mining according to the present invention was designed and is currently used in a test mine in Mexico. The test mine design is based on mining 6 m lifts of 1000 ton blocks of ore generated by a 3D geological block modal. Each DPM room is mined by 2 drift rounds or a combination of drift rounds and slashes that dimensionally match the geological block model; the model becomes the stopping plan for the orebodies with 100% ore recovery.

DPM mines the orebody from the top down. The initial lift utilizes standard drift and fill mining except a grid preferably of 7.5 m concrete posts and a continuous concrete floor is installed prior to backfilling with cemented rock fill (CRF). Lower lifts are similar to room and pillar mining but carried out under a concrete roof temporarily supported by a grid of concrete posts. As with any new technology there are a few new terms that have been developed to explain the system e.g. DPM top slicing, DPM rooms, double posting, pre breaking around posts and filler posts.

DPM is a very flexible mining method that can use drill blast muck techniques for hard ore and roadheaders for softer ores. Mining can be done in any direction under the concrete floor and it can extend out past the concrete to follow the ore—this new area then becomes a top slice. Every DPM room within the orebody will have exactly the same standard design. The outer perimeter rooms have the addition of wall pins and rebar hangers to support the perimeter of the concrete floor slab.

The backfill cycle is very standardized; install the posts, prepare and pour the concrete floors, then fill with CRF. Posting starts with drilling a grid of post holes surveyed to match the corner location of each ore block from the 3D location of the geological block model as shown in FIG. 1. A precast concrete post is than installed into each hole, followed by drilling pre-shearing holes around the post.

Preparation for installing the concrete floor starts with spreading a layer broken followed by a layer of plastic; the ore acts as a cushion to prevent blast damage to the concrete roof while the layer of plastic keeps wet concrete from leaking into the cushion material. At this time filler posts are installed in the DPM lifts—they are bolted to the bottom flange of the post from the previous lift forming the double posting system.

Rebar and welded concrete mesh can now be installed, followed by special concrete forms that are backfilled with sand. Removing the sand after the adjacent room is mined allows the rebar to be over lapped, thus forming a continuous concrete floor. Standard 3000 psi concrete is pumped to complete the reinforced slab. Once the concrete floor sets the CRF is tight filled using a push blade on an LHD plus a Paus Slinger truck for the nooks and crannies.

The DPM mining and backfill cycles use only standard mine proven equipment, concrete and CRF. Subsequent DPM mining is then carried out under the pre-posted composite roof beam comprised of reinforced concrete plus tightly-packed CRF.

The test mining area was computer modeled using FLAC 3D. Based on previous 2D modeling 0.4 m diameter concrete posts and a 7.5 m×7.5 m×6 m room size was fixed. An 8 room wide×12 room long by 5 lift high (or 400,000 t) area was selected to allow for maximum load development within the backfill; excavation is via primary and secondary panels 2 rooms (15 m) wide accessed from a central entry drift. The concrete floor was modeled only as a tension member as the concrete floor plus cemented rock fill act as a composite beam.

A total of 10 computer runs were performed using various stiffness' for the backfill, posts and floors; each run taking about 120 to 150 hours to completely mine the 480 blocks. Snapshots of data results were captured every 15 minutes for analysis.

Some of the results were:

1. Normal 6% cemented rock fill generated post loading mainly between 100 t and 250 t and the loads stabilized after 4 lifts. Posts were designed for 400 t thus post loading is about 50% of the design strength of the posts in compression.
2. To mobilize the backfill strength of typical 6% CRF the posts had to be compressible; weaker fills have to move further to arch loads to the walls thus causing more post compression. DPM has designed 400 t capacity compression springs that can be adjusted to match the required movement.
3. The concrete floors act only as a tensile member to confine the CRF and the loads arched as predicated. Backfill arching is seen on 2 scales—initially it remains within the DPM rooms; as additional lifts are mined it expands to cover the lift.
4. Surprisingly with weaker fills the tensile loads on the posts in the backfill increased to 300 t. The concrete posts in effect become large friction rockbolts in the composite CRF beam. To take advantage of this anchoring phenomenon the posts were redesigned with flanges to attain a continuous 150 t tensile strength for individual posts and 300 t for double posting.

Instrumentation

Through the years many attempts have been made to fully instrument a mine to provide useful, real-time feedback with regards to loads, stresses, etc. The present invention provides the framework for this type of instrumentation coverage.

The main item to be instrumented is the concrete post loading as one goes through the mining and backfill cycle. However this alone will not provide a snapshot of what is happening within the backfill and concrete floors—for example is the fill separating from the stope back while the backfill arches? This type of technical questioning soon lead to list of the various items that had to be monitored with unique instrumentation to provide the necessary answers.

A summary of the instrumentation installed in a quadrant of the test mine area or 9 sets of posts is as follows:

1. Instrumented cable bolts installed in the back above 9 post locations to measure the movement of the hanging wall or the convergence of the hanging wall (HW) into the backfill thus loading the backfill. Similarly cables could be installed from the roof through the CRF and bolted to the top of the 9 posts supporting the top concrete floor will measure the elevation of the concrete floor vs. the back to see if there is any separation of fill from the back. This will also see how far the concrete floor has moved down relative to the back of the stope.
3. Instrumented cables will measure a range of tensile loads in key areas of floor slab loading to monitor the tension in the rebar. Cables can also be installed around the perimeter of the floor slab to see what stresses are encountered near the edge of the floor. Similarly by draping instrumentation cables over a 2 inch diameter wall pin with the ends anchored in the floor slab the loading along edge of the floor slab along the walls can be measured.
4. The concrete post compression movement and post loading will be measured by the reduction in height of the compression members below the posts. The concrete posts have been designed with a conduit pipe to allow instrumentation wires to run though the post and through conduit imbedded in the concrete floor slabs. Post compression pads bolt to the post bottom flange and are reusable.
5. The tensile loading of the post can be measured in several ways, instrumented cable bolts cast in the concrete parallel to the rebar or a standard mine extensometer could be installed into a conduit in the post and anchored to the top and bottom steel flanges.
6. Instrumented ¾ inch dia. flange bolts will be used between the instrumented posts to monitor tensile loads from one post to the next.

The computer 3D model shows the backfill loads arching to the walls. Custom instrument packs are being developed to monitor the loads within the backfill to ensure the arching is developing as predicted, to check if the backfill is separating from the floor or back, and to monitor in real-time what is happening as the backfill is being compressed (packed) into place.

Tilt meters will be located in various areas of the concrete floor to see how the floor is bending near the concrete posts or how the floor edges bend as one goes through the mining or backfill cycle.

All of the instrumentation that leaves the Yield Point factory is calibrated with it's own on board computer and battery power supply. Each instrument has its own custom data file thus downloading data from a number of instruments automatically feeds into the proper data file. Data files can be updated at regular intervals as each lift is mined and at regular intervals i.e. every three months, the 3D model can be re-run.

It should be understood that the invention is not limited to the above described preferred embodiments, but that various modification obvious to those skilled in the art can be made without departing from the spirit of the invention and the scope of the following claims.

I claim:

1. A method of forming a continuous concrete floor in an undercut excavation, the method comprising the steps of:

a. excavating a first drift having a floor and side walls along its length;
b. installing a pattern of reinforcing steel in the form of mesh, rebar or screen to provide adequate strength to a concrete floor to be poured over the reinforcing steel;
c. installing forms around a perimeter of the floor of the first drift, wherein said forms installed against the walls of said first drift are a length equal to a length of any overlapping reinforcing steel to be installed in an adjoining drift when excavated;
d. filling said forms with sand so the reinforcing steel is covered;
e. then pouring or pumping concrete over the reinforcing steel and sand to form a concrete floor in the drift with a thickness sufficient to support cemented rock fill or the equivalent above the concrete floor when the drift is tightly backfilled;
f. removing the forms;
g. excavating a second drift having a floor and side walls along its length where the second drift is separated from the first drift by a third drift of unexcavated ore;
h. forming a concrete floor on the floor of the second drift following the method of steps a-f;
i. after the first drift and second drift have been backfilled with cemented rock fill, excavating a third drift between said first and second drifts, the third drift having a floor and side walls along its length;

j. removing the sand covering the ends of the reinforcing steel from under the concrete floor of the first and second drifts along the portion of the periphery of the first and second drifts adjoining the periphery of the third drift;

k. then providing reinforcing steel in the third drift extending to overlap the ends of the reinforcing steel in the first and second drifts; and l. pour or pump concrete over the reinforcing steel in the third drift to form a concrete floor in the third drift with a thickness sufficient to support cemented rock fill or the equivalent above the concrete floor when the third drift is tightly backfilled and the previous sand filled areas along the periphery of the first and second drifts and the overlapping reinforcing steel are covered with concrete to form a continuous concrete floor in the first, second and third drifts.

2. A method of forming a continuous concrete floor in an undercut excavation in accordance with claim 1 further comprising the additional steps of wherein after each of the first, second and third drifts have been excavated along their length, the floor of the each of the first, second and third drifts is backfilled with broken ore and graded, then a thin plastic layer is provided over the broken ore before installing the pattern of reinforcing steel.

3. A method of forming a continuous concrete floor in an undercut excavation according to claim 2 wherein after forming the concrete floor in the first or second drift, tightly backfilling the first or second drift with cemented rock fill or the equivalent before excavating the third drift between the first and second drifts up to the edge of the concrete floors in the first drift and the second drift.

4. A method of forming a continuous concrete floor in an undercut excavation according to claim 1 wherein after forming the concrete floor in the first or second drift, tightly backfilling the first or second drift and with cemented rock fill or the equivalent before excavating the third drift between the first and second drifts up to the edge of the concrete floors in the first drift and the second drift.

5. A method of forming a continuous concrete floor in an undercut excavation according to claim 1 wherein excavation of additional drifts on each level of the excavation is carried out according to steps a-l.

6. A method of forming a continuous concrete floor in an undercut excavation according to claim 1 comprising the additional steps of:

(i) before excavating any drifts at a level of the excavation, drilling holes of predetermined size and length in the ground above the level of the drifts;

(ii) placing at the bottom of each hole resilient elements capable of absorbing shock energy or excessive loads due to ground movements;

(iii) inserting concrete posts into the holes, the posts having their bottom ends resting on the resilient elements and having their top ends essentially flush with the ground, the posts being capable of supporting a concrete roof on their top ends;

(iv) pouring a concrete floor on the ground above the drifts and on the top ends of the posts; and (v) then excavating the drifts in accordance with steps a-l in claim 1 beneath the concrete floor which now serves as the concrete roof for the excavation.

7. A method of forming a continuous concrete floor in an undercut excavation according to claim 6 comprising the additional steps of installing an additional set of support posts in each drift prior to pouring the concrete floors.

8. A method of forming a continuous concrete floor in an undercut excavation according to claim 7 wherein instrumentation is installed along the reinforcing steel to measure stresses and tension loads on the concrete floors.

9. A method of forming a continuous concrete floor in an undercut excavation according to claim 8 wherein additional instrumentation is installed in one or more of locations selected from:

a. above and between post locations;

b. from the roof through the crushed rock fill and bolted to the top of the posts supporting the concrete floor above;

c. around the perimeter of the floor slab;

d. within a conduit pipe within the posts and through conduits imbedded in the concrete floor slabs; and e. within the crushed rock fill.

* * * * *